US006684802B2

(12) United States Patent
Keenan

(10) Patent No.: US 6,684,802 B2
(45) Date of Patent: Feb. 3, 2004

(54) SERRATED LEECH FLAPS FOR SAILS

(76) Inventor: Paul B. Keenan, 1122 Deer Run Rd., Ottsville, PA (US) 18942

( * ) Notice: Subject to any disclaimer, the term of this patent is extended or adjusted under 35 U.S.C. 154(b) by 0 days.

(21) Appl. No.: 10/244,629

(22) Filed: Sep. 17, 2002

(65) Prior Publication Data

US 2003/0066468 A1 Apr. 10, 2003

Related U.S. Application Data

(60) Provisional application No. 60/322,450, filed on Sep. 17, 2001.

(51) Int. Cl.[7] ..... B63H 9/04

(52) U.S. Cl. ..... 114/102.13; 114/102.29

(58) Field of Search ..... 114/102.1, 102.12, 114/102.13, 102.16, 102.22, 102.29, 102.32, 102.33, 39.29, 39.31

(56) References Cited

U.S. PATENT DOCUMENTS

| | | | | |
|---|---|---|---|---|
| 4,542,868 A | | 9/1985 | Boyd | |
| 5,088,665 A | | 2/1992 | Vijgen et al. | |
| 6,070,545 A | | 6/2000 | Keenan | |
| 6,116,178 A | * | 9/2000 | McCabe | 114/102.13 |

FOREIGN PATENT DOCUMENTS

| | | | | |
|---|---|---|---|---|
| FR | 2552393 | * | 3/1985 | 114/102.33 |
| GB | 2231854 | * | 11/1990 | 114/102.33 |

OTHER PUBLICATIONS

"Wind–Tunnel Investigations of Wings with Serrated Sharp Trailing Edges", Vijgen et al, *Lecture Notes in Engineering, 54*, Springer–Verlag, 1989.

* cited by examiner

*Primary Examiner*—S. Joseph Morano
*Assistant Examiner*—Andrew Wright
(74) *Attorney, Agent, or Firm*—Michael de Angeli

(57) ABSTRACT

In an improved sail for a sailboat, the trailing edges of a pair of serrated flaps of sailcloth are attached to the trailing edge of the sail, one on each side; the leading portions of corresponding members making up the serrated flaps are not fixed to the sail, but are connected to one another by short sections of line extending through holes in the sail. When the boat is tacked from one tack to the other, the leading portions of the members on the new windward side are pulled away from the surface of the sail by the wind, so that a serrated flow-impeding lip is provided on the windward side of the leech. At the same time, the lines pull the leeward members against the main body of the sail, so that drag is not increased substantially. Substantial improvements in sailing performance are realized, while no control action is required to cause the flaps to be suitably reconfigured upon tacking, and while ordinary sailing manuevers and all normal sail handling operations may be carried out without complication.

22 Claims, 1 Drawing Sheet

SERRATED LEECH FLAPS FOR SAILS

CROSS-REFERENCE TO RELATED APPLICATION

This application claims priority from Provisional Poatent Application Ser. No. 60/322,450, filed Sep. 17, 2001.

FIELD OF THE INVENTION

This invention relates to leech flaps for sails for sailboats.

BACKGROUND OF THE INVENTION

The inventor is the inventor of U.S. Pat. No. 6,070,545, which is incorporated herein by this reference. In that patent, the inventor discloses and claims self-tacking leech flaps for sails for sailboats. Briefly, according to the invention of his issued patent, narrow flaps of sailcloth are added to the trailing edge or "leech" of a sail. The trailing edges of the flaps are sewn to the trailing edge of the sail, while the leading edges of the flaps are not attached to the sail. Instead, the leading edges of the flaps are joined to one another by light cords spaced at intervals along the length of the leech and extending through holes in the main membrane of the sail. These cords are of a length sufficient to allow the flap on the windward side of the sail to be pulled outwardly from the main membrane of the sail, forming a flow-impeding lip on the windward side of the sail. At the same time, the flap on the other side of the sail is pulled against the main membrane thereof, so that there is little increase in drag.

The flow-impeding lip thus provided on the windward side of the sail at the leech causes a low-pressure area to be formed behind the flap. This in turn pulls the flow on the leeward side of the sail closer to the leeward surface of the sail, which both increases lift and reduces drag.

The leech flaps provided according to the issued patent are self-tacking in that when the sailboat is tacked, that is, when the former leeward surface becomes the new windward surface, the flaps automatically reconfigure themselves, so that the flow-impeding lip is now provided on the new windward surface. Hence addition of the flaps according to the invention does not complicate ordinary sailing manuevers.

SUMMARY OF THE PRESENT INVENTION

The present provisional application discloses several further improvements on the leech flaps of the parent patent. The principal improvement provided hereby is to the effect that the leech flaps are desirably serrated. That is, rather than being provided as continuous flaps joined to one another by strings provided at intervals, the flaps are configured as a series of opposed triangles (or comparably-shaped members) the apexes of which are joined by the strings; the bases of the triangles are secured to the trailing edge of the sail.

In a preferred embodiment, the triangles themselves are made up of relatively stiff "high modulus" sailcloth, so that they hold their shape despite being secured by a single string at the apex of each. This material is too stiff to readily form a flexible hinge connecting the triangles to the main membrane of the sail. Accordingly, the triangles may be sewn to a ribbon of softer material, such as an ordinary taffeta ribbon, which in turn is sewn to the main membrane of the sail.

The height of the triangles is selected to be between 1 and 5% of the chord of the sail at their position along the leech; that is, the height of the triangles is reduced as the sail becomes more narrow towards the head.

BRIEF DESCRIPTION OF THE DRAWINGS

The invention will be better understood if reference is made to the accompanying drawings, in which.

DESCRIPTION OF THE PREFERRED EMBODIMENTS

Figure 1:
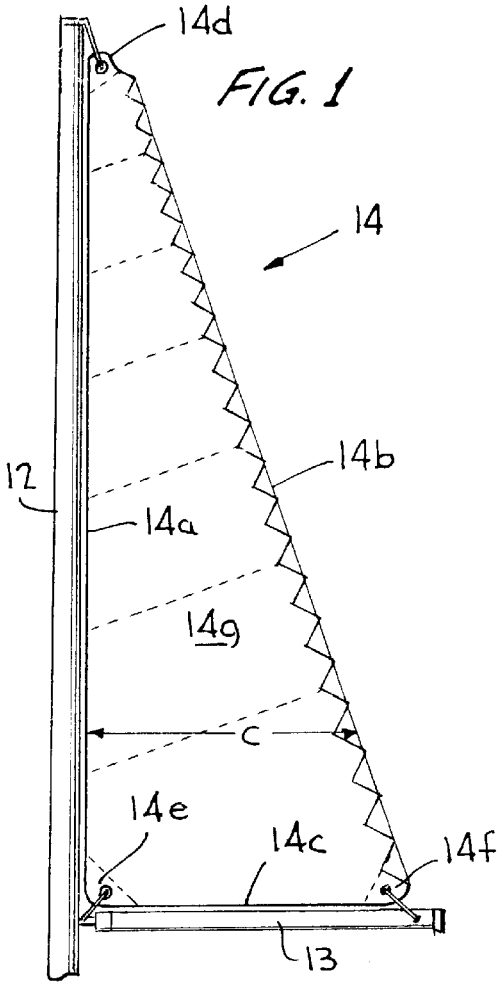
FIG. 1 shows a side view of a sail having had the serrated flaps according to the invention added thereto.

As indicated, FIG. 1 shows a side view of a conventional sail, here exemplified as a typical mainsail 14 supported by a mast 12 and having its lower edge or foot 14*c* extending along a boom 13. The forward or leading edge of the sail 14*a* is referred to as the luff, and the after or trailing edge 14*b* as the leech; the upper corner 14*d* of the sail is termed the head, the lower forward corner 14*e* the tack, and the lower rear corner 14*f* the clew. The principal planar component of the sail 14 is referred to herein as the "main membrane" 14*g*.

As in the inventor's issued patent, according to the present invention a pair of flaps are secured to the leech 14*b*. Unlike the continuous flaps shown in the patent, however, those added according to the present invention are "serrated", that is, comprise a series of generally similar members of sailcloth, secured on either side of the leech, and arranged to open on the windward side of the sail, so as to provide an improvement in the sail's lift-to-drag ratio under appropriate circumstances. The series of members are spaced similarly on both sides of the sail, so that the cords extending through the sail join corresponding members at their leading portions.

Figure 2:
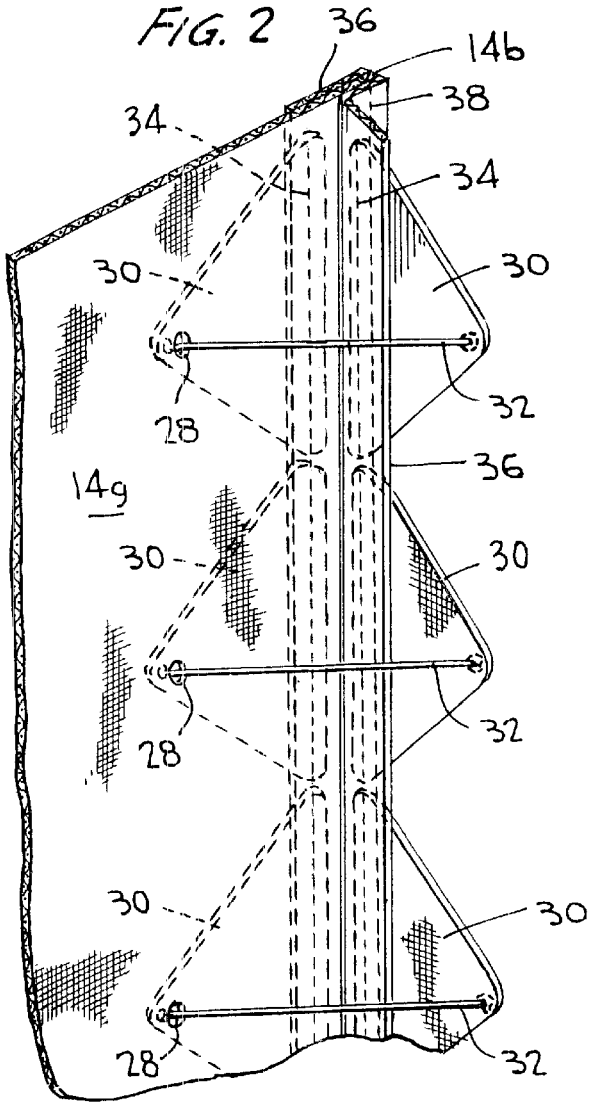
FIG. 2 shows a perspective view through the leech of the sail, in one embodiment of the invention.
Figure 3:
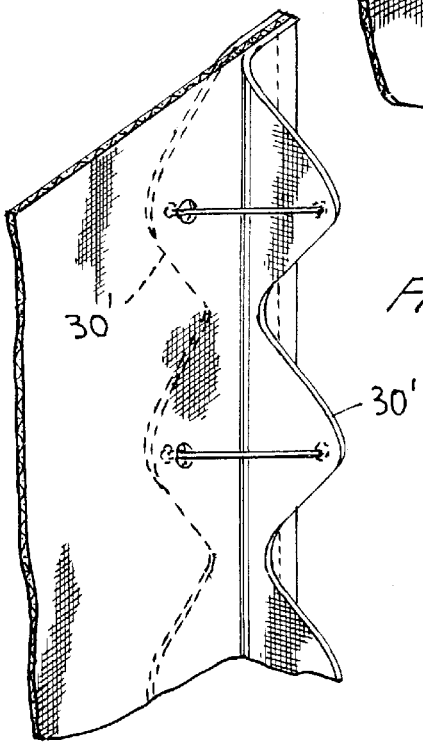
FIG. 3 shows a view comparable to that of FIG. 2, in a second embodiment of the invention.

The generally similar members making up the serrated flaps may be triangular in outline, as shown in FIGS. 1 and 2, generally sinusoidal in outline, as shown in FIG. 3, or otherwise define a leading edge exhibiting spaced portions extending relatively away from the leech of the sail, and interspersed by portions not extending as far from the leech. For example, the serrations could be made up of a series of spaced square or rectangular members sewn to the leech of the sail.

The operation of the serrated flaps, and the theory by which they provide an improvement over a sail with no leech flaps, is as set forth in the parent patent; that is, the series of similar members now comprising the windward flap is urged open by the wind, and the connecting cords pull the corresponding leeward members closed. The serrated flaps of the present invention provide a distinct but not yet precisely quantifiable further improvement in the lift-to-drag ratio of the sail with respect to the continuous flaps of the parent patent.

That serrated or scalloped flaps may be beneficial under certain aerodynamic circumstances, and in particular may provide performance improvements over continuous flaps, is suggested generally in the aerodynamic art; see U.S. Pat. No. 5,088,665 to Vijgen et al, and "Wind-Tunnel Investigations of Wings with Serrated Sharp Trailing Edges", by the same authors, in *Lecture Notes in Engineering,* 54, Springer-Verlag 1989, (Mueller, ed.), pp. 295–313; also see Boyd U.S. Pat. No. 4,542,868. However, none of these references suggest the use of such serrated edges in sails for sailboats, much less self-tacking serrated flaps made of a flexible material such as sailcloth, as disclosed herein.

FIG. 2 shows additional details of the serrated flaps of the present invention. As shown, the flaps may be made up of a series of pairs of triangular fabric members 30 secured on either side of the leech of the main membrane 14*g* of the sail. A control cord 32 extends from the leading portion of each member 30, in this embodiment a forward-extending apex of the triangular member, through a hole 28 in the main membrane 14*g*, and is secured to the tip of the corresponding opposing member 30, so that as the serrated flap made up of members 30 on one side of the main membrane open when that side of the sail becomes the windward side, the members of the flap on the other side close, all as described in the parent patent.

In order that the triangular members 30 can hold their shape when constrained only by a control cord at their apex, they are preferably made of a relatively stiff material; a typical "high modulus" sailcloth is suitable. However, this material is too stiff to form the "hinges" at which the members bend back and forth. Therefore, in the embodiment shown in FIG. 2, two series of individual triangular members 30 are themselves sewn, as indicated by lines of stitches 34, to corresponding strips or ribbons 36 of more flexible material, which are then sewn on either side of the leech 14*b* of the sail 14, as indicated by further stitching 38. The ribbons then form the hinges necessary for the proper motion of the triangular flaps, as illustrated. Ordinary taffeta ribbon material can be used for this purpose.

In a successfully-tested embodiment, the triangular members 30 were configured as 45°-90°-45° right triangles, with the cords extending through holes near the 90° apexes of each. The control cords 32 were simply knotted on the outer sides of the holes in the leading portion of each of the triangular members 30; children's beads can be used as washers to reduce chafing of the knots against the members 30. However, clearly the invention is not to be so limited.

Similarly, the members 30 need not be triangles per se; scalloped members, i.e., of generally sinusoidal shape, might be equally effective, as shown at 30' in FIG. 3. FIG. 3 also shows the members 30' having been formed by cutting the leading edge of a strip of sailcloth, the trailing edge being sewn to the trailing edge of the leech; that is, in this embodiment the ribbons 36 of the FIG. 2 embodiment are dispensed with. In either case, the apex of a triangular member, or the portion of a sinusoidal or other member extending furthest from the leech of the sail, is referred to as the leading portion thereof, and the control cord is secured thereto; the opposite portion of the member, which is straight, is referred to as the trailing edge.

As above, the series of members can be individual members each sewn to a ribbon or to the main membrane of the sail, as in FIG. 2, or each series of members can be formed from a continuous strip of material, having the leading edge cut to define the individual members and the other continuous, to form the trailing edge thereof, as in FIG. 3. The trailing edge of one such strip would then be sewn to either side of the leech of the main membrane of the sail.

As illustrated in FIG. 1, the size of the triangular (or otherwise shaped) members 30 varies along the length of the leech so as to remain in an approximately constant proportion to the chord C of the sail at any given point along the leech. In a successfully-tested embodiment, the height of the members (measured from the apex of the leading portion to the line along which the members meet the main membrane of the sail) was 1% of the chord C, but the invention is again not to be so limited; the height of the members might be up to 5% of the chord.

While a preferred embodiment of the invention has been disclosed, the invention is not to be limited thereby.

What is claimed is:

1. Serrated leech flaps for being applied to either side of a trailing edge of a leech of a sail of a sailboat, each leech flap comprising a series of members of sailcloth, each member being formed to define a leading portion and a trailing edge, the trailing edges of each member being adapted to be secured to either side of the trailing edge of the leech of the sail, and a plurality of control cords adapted to be attached to the leading portion of each said member and pass through apertures in said sail for attachment to the leading portion of a corresponding member on the opposite side of the leech of the sail, and wherein the members are generally triangular in outline, with an apex of each triangular member forming the leading portion thereof.

2. The leech flaps of claim 1, wherein the height of the members, measured from the leading portion thereof to the line along which the members meet a main membrane of the sail, is between about 1% and about 5% of the chord of said sail.

3. The leech flaps of claim 1, wherein the members are formed by cutting a leading edge of a strip of sailcloth to form said members, with a trailing edge of said strip of sailcloth being secured to the trailing edge of the leech of said sail.

4. The leech flaps of claim 1, wherein the members are formed individually and sewn to a ribbon in turn sewn to the leech of said sail.

5. A sail for a sailboat, said sail having a leading edge or luff, a trailing edge or leech, and a pair of leech flaps, each leech flap comprising a series of members of sailcloth, each member being formed to define a leading portion and a trailing edge, the trailing edges of each member being adapted to be secured to either side of the leech of the sail, and a plurality of control cords adapted to be attached to the leading portion of each said member and pass through apertures in said sail for attachment to the leading portion of a corresponding member on the opposite side of the leech of the sail, and wherein the members are generally triangular in outline, with an apex of each triangular member forming the leading portion thereof.

6. The sail of claim 5, wherein the height of the members, measured from the leading portion thereof to the line along which the members meet a main membrane of the sail, is between about 1% and about 5% of the chord of said sail.

7. The sail of claim 5, wherein the members are formed by cutting a leading edge of a strip of sailcloth to form said members, with a trailing edge of said strip of sailcloth being secured to the trailing edge of the leech of said sail.

8. The sail of claim 5, wherein the members are formed individually and sewn to a ribbon in turn sewn to the leech of said sail.

9. An improved sail for a sailboat, said sailboat comprising sail support and control means such that in use either side of a main membrane of said sail may be controllably exposed to wind, said improved sail having a pair of serrated flaps disposed on either side of a trailing edge of said sail off which trailing edge wind flows in use, said serrated flaps each comprising a series of members each having a leading portion extending away from the the trailing edge of said main membrane of said sail and a trailing portion secured to the the trailing edge of said main membrane of said sail, the leading portions of said members on either side of the main membrane of said sail being aligned with one another, and the leading portions of respective ones of said members being joined by control cords passing through the main membrane of said sail, whereby as a member on a windward side of said main membrane is pulled away from the main membrane by the wind, the corresponding member on the leeward side of the main membrane is drawn toward the main membrane, such that the member on the windward side substantially impedes flow of air off the windward side of the trailing edge of the sail, and the member on the leeward side only minimally impedes flow of air off the leeward side of the trailing edge of the sail.

10. The sail of claim 9, wherein the members are generally triangular in outline, with an apex of each triangular member forming the leading portion thereof.

11. The sail of claim 9, wherein the leading portion of the members is generally sinusoidal in outline.

12. The sail of claim 9, wherein the height of the members, measured from the leading portion thereof to the line along which the members meet the main membrane of the sail, is between about 1% and about 5% of the chord of said sail.

13. The sail of claim 9, wherein the members are formed by cutting a leading edge of a strip of sailcloth to form said members, with a trailing edge of said strip of sailcloth being secured to the trailing edge of said sail.

14. The sail of claim 9, wherein the members are formed individually and sewn to a ribbon in turn sewn to the trailing edge of said sail.

15. Serrated leech flaps for being applied to either side of a trailing edge of a leech of a sail of a sailboat, each leech flap comprising a series of members of sailcloth, each member being formed to define a leading portion and a trailing edge, the trailing edges of each member being adapted to be secured to either side of the trailing edge of the leech of the sail, and a plurality of control cords adapted to be attached to the leading portion of each said member and pass through apertures in said sail for attachment to the leading portion of a corresponding member on the opposite side of the leech of the sail, and wherein the leading portion of the members is generally sinusoidal in outline.

16. The leech flaps of claim 15, wherein the height of the members, measured from the leading portion thereof to the line along which the members meet a main membrane of the sail, is between about 1% and about 5% of the chord of said sail.

17. The leech flaps of claim 15, wherein the members are formed by cutting a leading edge of a strip of sailcloth to form said members, with a trailing edge of said strip of sailcloth being secured to the trailing edge of the leech of said sail.

18. The leech flaps of claim 15, wherein the members are formed individually and sewn to a ribbon in turn sewn to the leech of said sail.

19. A sail for a sailboat, said sail having a leading edge or luff, a trailing edge or leech, and a pair of leech flaps, each leech flap comprising a series of members of sailcloth, each member being formed to define a leading portion and a trailing edge, the trailing edges of each member being adapted to be secured to either side of the leech of the sail, and a plurality of control cords adapted to be attached to the leading portion of each said member and pass through apertures in said sail for attachment to the leading portion of a corresponding member on the opposite side of the leech of the sail, and wherein the leading portion of the members is generally sinusoidal in outline.

20. The sail of claim 19, wherein the height of the members, measured from the leading portion thereof to the line along which the members meet a main membrane of the sail, is between about 1% and about 5% of the chord of said sail.

21. The sail of claim 19, wherein the members are formed by cutting a leading edge of a strip of sailcloth to form said members, with a trailing edge of said strip of sailcloth being secured to the trailing edge of the leech of said sail.

22. The sail of claim 19, wherein the members are formed individually and sewn to a ribbon in turn sewn to the leech of said sail.

* * * * *